US012527453B2

(12) United States Patent
Tütek

(10) Patent No.: US 12,527,453 B2
(45) Date of Patent: Jan. 20, 2026

(54) ROTATING INJECTION PROPELLER WITH 2K-SEAL

(71) Applicant: SERDAR PLASTİK SANAYI VE TİCARET ANONİM ŞİRKETİ, Sincan/Ankara (TR)

(72) Inventor: Serdar Tütek, Sincan/Ankara (TR)

(73) Assignee: SERDAR PLASTIK SANAYI VE TICARET ANONIM SIRKETI (TR)

( * ) Notice: Subject to any disclaimer, the term of this patent is extended or adjusted under 35 U.S.C. 154(b) by 355 days.

(21) Appl. No.: 17/432,111

(22) PCT Filed: Feb. 21, 2020

(86) PCT No.: PCT/TR2020/000001
§ 371 (c)(1),
(2) Date: Aug. 19, 2021

(87) PCT Pub. No.: WO2020/171788
PCT Pub. Date: Aug. 27, 2020

(65) Prior Publication Data

US 2022/0133123 A1 May 5, 2022

(30) Foreign Application Priority Data

Feb. 21, 2019 (TR) ..... 2019/02651

(51) Int. Cl.
*A47L 15/22* (2006.01)
*A47L 15/42* (2006.01)

(52) U.S. Cl.
CPC ..... *A47L 15/22* (2013.01); *A47L 15/428* (2013.01)

(58) Field of Classification Search
CPC .... A47L 15/22; A47L 15/428; A47L 15/4278; A47L 15/20; A47L 15/4223; A47L 15/23; A47L 15/4282; A47L 15/16; A47L 15/18
USPC ..... 134/198
See application file for complete search history.

(56) References Cited

U.S. PATENT DOCUMENTS 2,859,061 A * 11/1958 Reid ..... F16J 15/328 156/215
2,905,393 A * 9/1959 Federighi ..... A47L 15/4278 239/110
4,330,136 A * 5/1982 Henson ..... F16J 15/104 277/921

(Continued)

FOREIGN PATENT DOCUMENTS

DE 102012006379 A1 * 10/2013 ..... A47L 15/23
JP H11201289 A * 7/1999
WO WO-2020171788 A2 * 8/2020 ..... A47L 15/22

OTHER PUBLICATIONS

Machine translation of JP-H11201289 (Year: 1999).*

*Primary Examiner* — Michael E Barr
*Assistant Examiner* — Thomas Bucci

(57) ABSTRACT

It is a propeller with an injection apparatus, that extends outwardly from a vertical water pole, rotates such that it forms a peripheral movement through its water pressure in dishwashers. It is a rotating propeller with a 2K sealing element and a clamp structure and an injection feature, that is defined with a vertical leaning surface at its end portion and with an inner edge shape such that it has a partial cylindrical shape, wherein it is molded with a PP material, wherein body of each thereof is of longitudinal and wherein it comprises a lower wall and an upper wall.

1 Claim, 19 Drawing Sheets

(56) References Cited

U.S. PATENT DOCUMENTS 4,387,496 A * 6/1983 Spiegel ..... B21D 53/00 29/509
4,442,174 A * 4/1984 Neumann ..... F16J 15/104 428/398
4,558,875 A * 12/1985 Yamaji ..... E04B 1/6801 106/DIG. 4
5,267,582 A * 12/1993 Purtilo ..... A47L 15/22 134/180
5,374,473 A * 12/1994 Knox ..... B29D 99/0053 428/218
5,427,129 A * 6/1995 Young, Jr. ..... A47L 15/23 239/164
5,662,744 A * 9/1997 Tuller ..... A47L 15/23 239/257
5,863,800 A * 1/1999 Eikmeier ..... B01L 9/52 422/547
6,114,004 A * 9/2000 Cydzik ..... B62D 29/002 428/192
6,964,090 B2 * 11/2005 Mathieu ..... A47L 15/23 29/458
7,753,062 B2 * 7/2010 Burrows ..... A47L 15/23 134/198
9,295,368 B2 * 3/2016 Feddema ..... A47L 15/4289
9,386,903 B2 * 7/2016 Feddema ..... A47L 15/4282
9,532,699 B2 * 1/2017 Feddema ..... A47L 15/4289
9,795,273 B2 * 10/2017 Pyo ..... A47L 15/428
9,839,340 B2 * 12/2017 Feddema ..... A47L 15/4282
10,052,010 B2 * 8/2018 Feddema ..... A47L 15/23
10,876,632 B2 * 12/2020 Nachtmann ..... F16J 15/102
10,939,797 B2 * 3/2021 Yoo ..... A47L 15/23
11,937,051 B2 * 3/2024 Kirchhoff ..... H04R 25/65
2003/0030232 A1 * 2/2003 Westra ..... A47L 9/00 277/628
2004/0045988 A1 * 3/2004 van der Klaauw .. B67D 1/0848 222/400.7
2005/0230971 A1 * 10/2005 Sakazaki ..... F16L 33/18 285/252
2007/0045967 A1 * 3/2007 Park ..... F16J 15/3228 277/534
2008/0271759 A1 * 11/2008 Burrows ..... A47L 15/23 134/172
2012/0217424 A1 * 8/2012 Klein ..... F16L 5/10 251/4
2013/0074888 A1 * 3/2013 Feddema ..... A47L 15/23 134/178
2013/0255734 A1 * 10/2013 Hermann ..... A47L 15/4278 134/198
2014/0246059 A1 * 9/2014 Feddema ..... A47L 15/428 134/198
2014/0246060 A1 * 9/2014 Feddema ..... A47L 15/4282 134/198
2014/0367922 A1 * 12/2014 Martin ..... F16J 15/06 277/590
2017/0354308 A1 * 12/2017 Choi ..... A47L 15/4282
2017/0354310 A1 * 12/2017 Yoo ..... A47L 15/4278
2024/0091101 A1 * 3/2024 Gallmetzer ..... A61J 1/1468

* cited by examiner

ROTATING INJECTION PROPELLER WITH 2K-SEAL

The present invention relates to, in general, a rotating injection apparatus and a molded plastic injection arm with a 2K-seal system, formed in an integrated manner therewith. The inventive rotating injection propeller comprises a 2K-seal element that is formed of PP material, is resistant to higher temperatures, chemicals, and pressure and has a stainless and light body, wherein it relates to ensuring sealing by stretching and compressing the sealing elements with a triangle and round section thereon by means of 2K (dual component) technology without requiring any sealing test. Interior stress may occur due to the hot welding process (Hot Plate) or visible defects, sealing problems, residual stress and distortions and areas affected by the heat may occur on the welding area due to the vibration welding process. In such cases, sealing problems may occur due to the fact that the desired level of adhesion cannot be ensured.

RELATED TECHNICAL FIELD OF THE INVENTION

It is a propeller with an injection apparatus, that extends outwardly from a vertical water pole, rotates such that it forms a peripheral movement through its water pressure in dishwashers and in machines with similar washing function. It is a rotating propeller with an injection feature, that is defined with a vertical leaning surface at its end portion and with an inner edge shape such that it has a partial cylindrical shape, wherein it is molded with a PP material, wherein body of each thereof is of longitudinal and wherein it comprises a lower wall and an upper wall. In machines with such features, dirty dishes or other products are placed into a washing chamber and they are subjected to a high-flow water injection effect of washing sprayers. Washing water is circulated for a sufficient period so as to loosen and remove food residues on the products and the injection processes are maintained and said residues are removed by means of the powerful water injection and washing fluid. Since the propeller with said injection feature loses its sealing property causes to decrease the water injection intensity on the propeller, the washing performance is affected negatively.

STATE OF THE ART AND PROBLEMS AIMED TO BE SOLVED THROUGH THE INVENTION

In the prior art, the sensitivity of the plastics against bolting may initiate cracks because of rivet or bolting, deformations on the plastics may occur due to bolting and therefore, adhesion through hot welding process or vibration welding process in the assembly comes into the forefront. It is necessary that plastic materials firstly are softened and then hardened again in the welding process. Two areas of thermoplastics to be welded through the hot welding process should be melted and sufficient pressure should be implemented for the adhesion. Through this method, internal stresses occur during melting and cooling the partial area on the plastic. Another assembly process is a welding process carried out by means of applying vibration and pressure on plastics in the vibration welding mold. Materials should be heated up around the melting temperature for this process and are assembled through the vertical vibration method. Visible defects, residual stress and distortions, and areas affected by the heat may occur in the welding area due to the vibration welding process. When water injection apparatuses of the dishwasher are manufactured through Hot Plate (How Welding) method or vibration welding, the desired sealing effect cannot be ensured, in case the welding quality is insufficient, thereby affecting the performance of the machine negatively. So as to avoid such cases, every part is subjected to a sealing test after the welding and defective parts are sorted out. This also causes additional cost and time loss.

BRIEF DESCRIPTION OF THE INVENTION

It is a propeller with an injection apparatus, that extends outwardly from a vertical water pole, rotates such that it forms a peripheral movement through its water pressure in dishwashers.

It is a rotating propeller with an injection feature and a 2K sealing element, that is defined with a vertical leaning surface at its end portion and with an inner edge shape such that it has a partial cylindrical shape, wherein it is molded with a PP material, wherein body of each thereof is of longitudinal and wherein it comprises a lower wall and an upper wall. It relates to ensuring the sealing effect by means of stretching and compressing the sealing element with a triangle and round section thereon with 2K (dual component) technology, that can be de-/mounted by means of its clamp structure. By means of the sealing element surrounding the entire assembled surface of the lower part and the groove surrounding the entire surface on the upper part corresponding to the assembly, since the sealing element is seated in the groove after the assembly, the absolute sealing effect is ensured without performing any test, thereby providing the sealing guaranty. Groove and sealing elements on the lower and upper propellers may be repositioned such that they are on the lower and upper parts.

DETAILED DESCRIPTION OF THE INVENTION

The present invention relates to a rotating injection propeller with a 2K sealing element, that comprises an injection apparatus extending outwardly from a vertical water pole in dishwasher, comprising a peripheral flange and a cylindrical body, and that can be opened and closed by means of its clamp structure. Dirt accumulated on the injection apparatus over time choke up the injection mouth and affect the injection performance negatively. Body with a 2K sealing element and a clamp structure allows for cleaning injection mouths by means of its attachable and detachable structure. It is a rotating propeller with an injection feature and a 2K sealing element, that is defined with a vertical leaning surface at its end portion and with an inner edge shape such that it has a partial cylindrical shape, wherein it is molded with a PP material, wherein body of each thereof is of longitudinal and wherein it comprises a lower wall and an upper wall.

Upper and lower elements are attached to each other by means of clamps and there is a groove molded on one of the adjacent surfaces of the related elements and a sealing element on the other surface, that is manufactured with 2K manufacturing technology. The sealing element surrounding the entire assembled surface of the lower part is seated precisely in the groove surrounding the entire surface on the upper part corresponding to the assembly, thereby ensuring the sealing effect. By means of said manufacturing technique, the rotating injection propeller with a 2K sealing feature is manufactured without requiring any sealing test, additional cost and time loss, causing any internal stress on the plastic part. Groove and sealing elements on the lower and upper propellers may be repositioned such that they are on the lower and upper parts.

The upper part (1) of the inventive propeller constitutes the upper half portion of the propeller and the injection washing ends are on said portion. Sealing groove (4) or sealing element (3) may be on said part. It completes the propeller when it is assembled with the lower part (2).

The lower part (2) of the inventive propeller constitutes the lower half portion of the propeller and ends that rotate the propeller are on said portion. Sealing groove (4) or sealing element (3) may be on said part. It completes the propeller when it is assembled with the upper part (1).

The sealing element (3) of the inventive propeller is on the upper part (1) or lower part (2). Its task is to ensure the sealing effect by being seated in the groove (4) on the other propeller part.

The sealing groove (4) of the inventive propeller is on the upper part (1) and lower part (2). Its task is to ensure the sealing effect by seating the sealing element (3) on the other propeller part therein.

Mounting clamps (5) of the inventive propeller clamp the upper propeller part (1) and lower propeller part (2) to each other and both ensure the sealing effect and keep the propeller in one piece by means of combining the sealing groove (4) with the sealing element (3).

REFERENCE LIST

Figure 1:
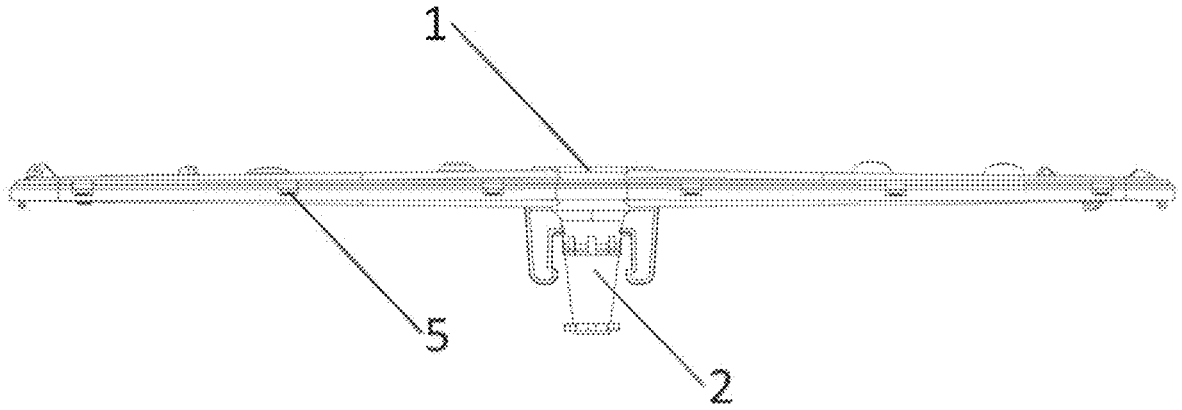
FIG. 1—Front view of the lower propeller
FIG. 2—Side view of the lower propeller
FIG. 3—Upper view of the lower propeller
FIG. 4—Lower view of the lower propeller
FIG. 5—Isometric upper view of the lower propeller
FIG. 6—Isometric lower view of the lower propeller
FIG. 7—Side sectional view of the lower propeller
FIG. 8—Isometric exploded upper view of the lower propeller
FIG. 9—Isometric exploded lower view of the lower propeller
FIG. 10—Front view of the upper propeller
FIG. 11—Side view of the upper propeller
FIG. 12—Upper view of the upper propeller
FIG. 13—Lower view of the upper propeller
FIG. 14—Isometric upper view of the upper propeller
FIG. 15—Isometric lower view of the upper propeller
FIG. 16—Side sectional view of the upper propeller
FIG. 17—Isometric exploded upper view of the upper propeller
FIG. 18—Isometric exploded lower view of the upper propeller
FIG. 19—Sectional view of the lower-upper propeller groove and sealing element
Figure 2:
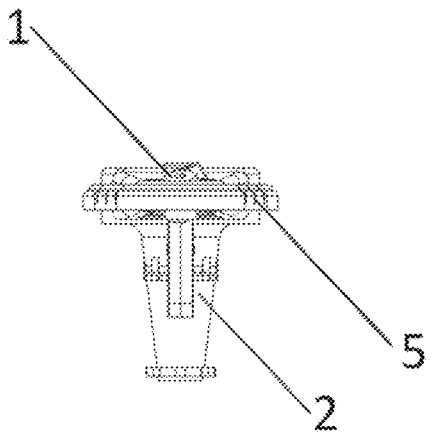
Figure 3:
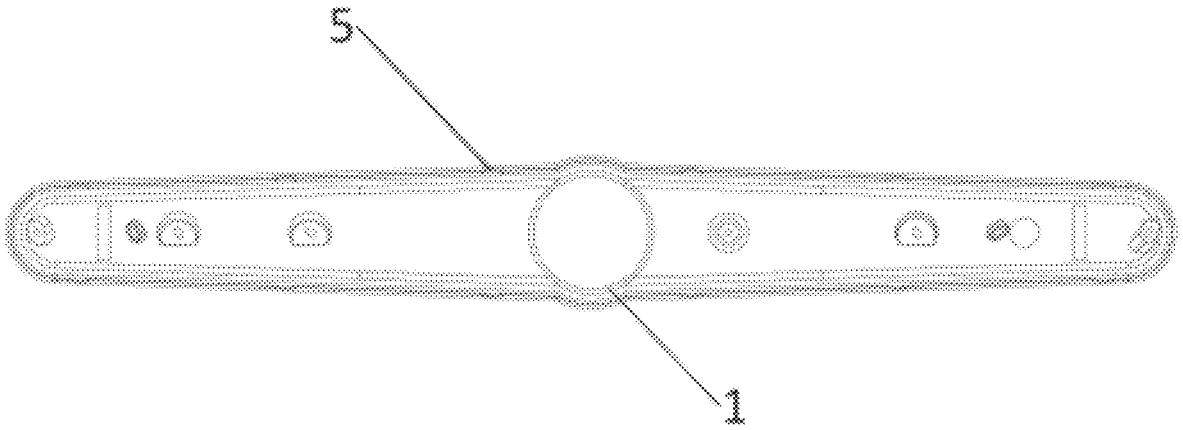
Figure 4:
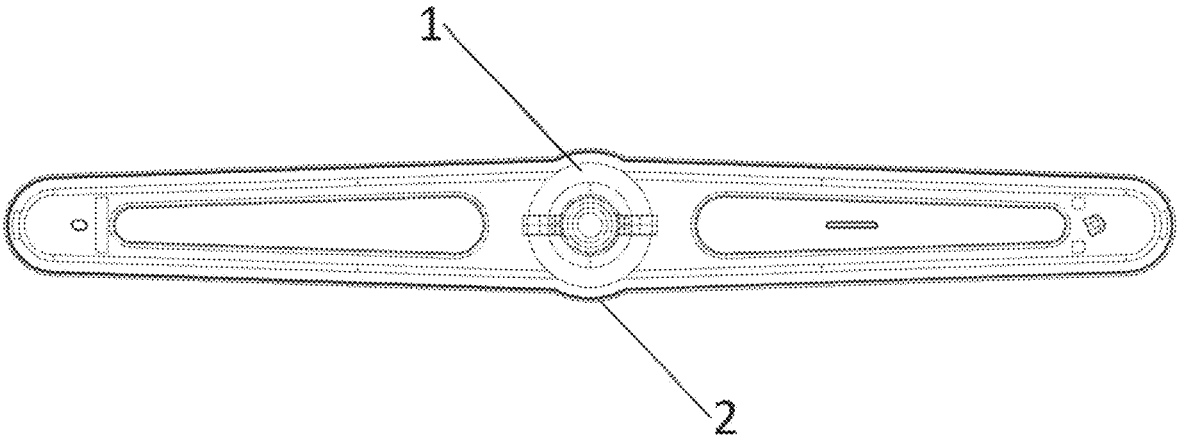
Figure 5:
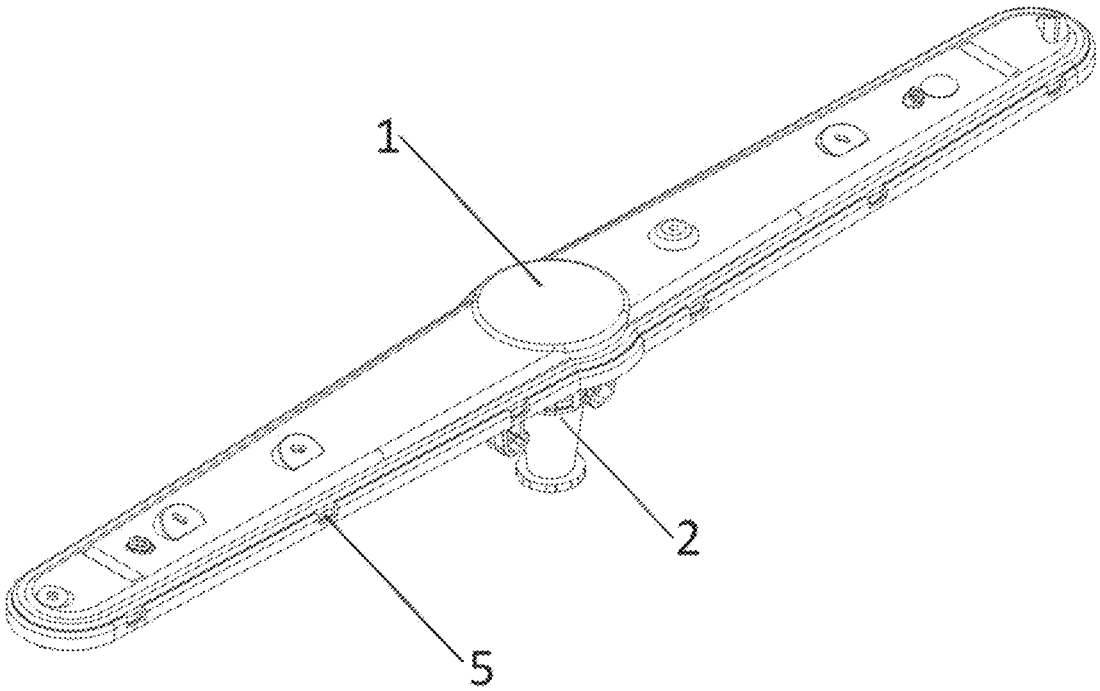
Figure 6:
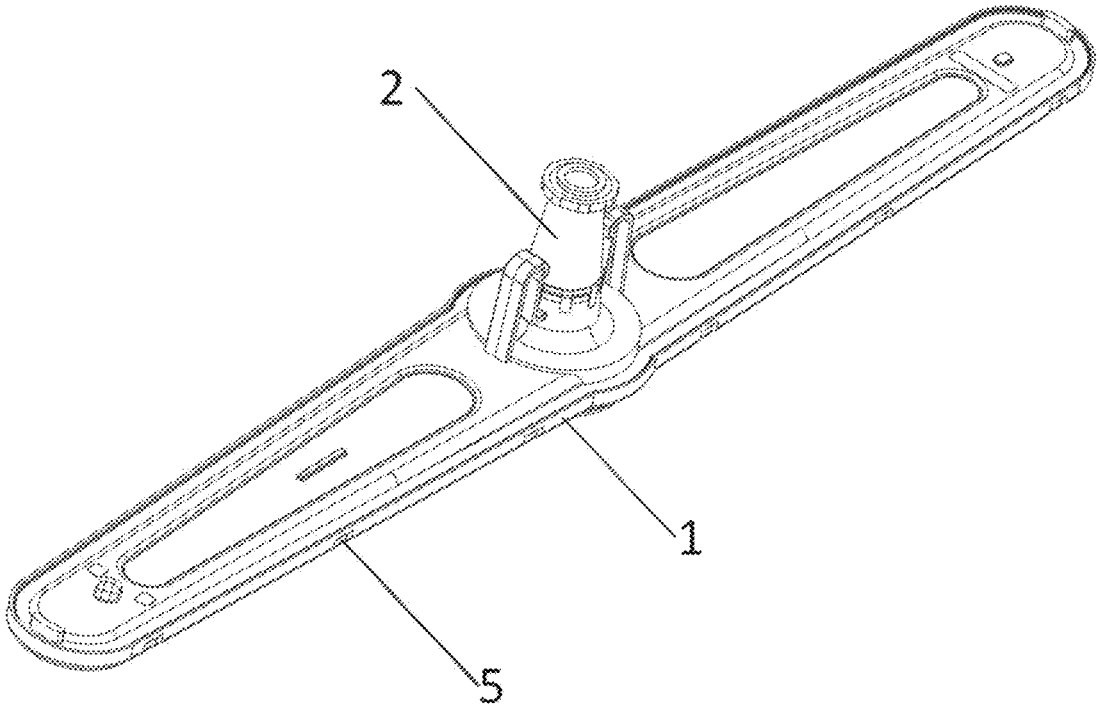
Figure 7:
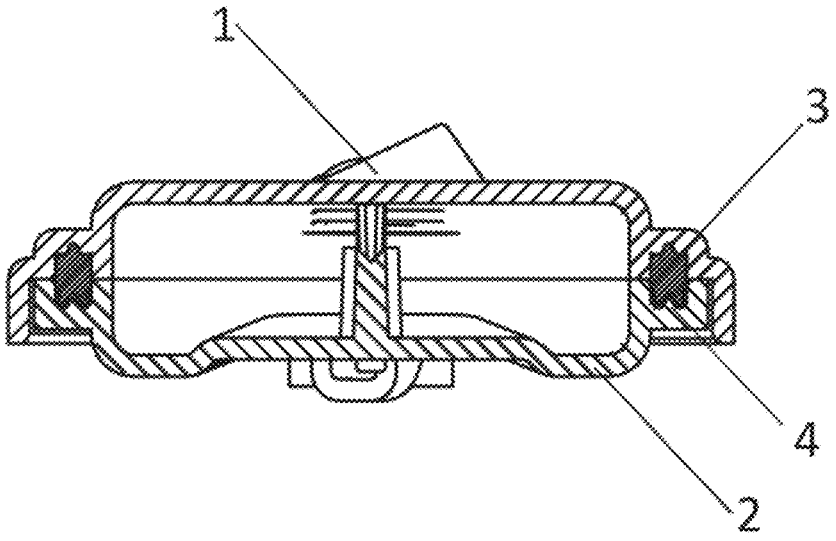
Figure 8:
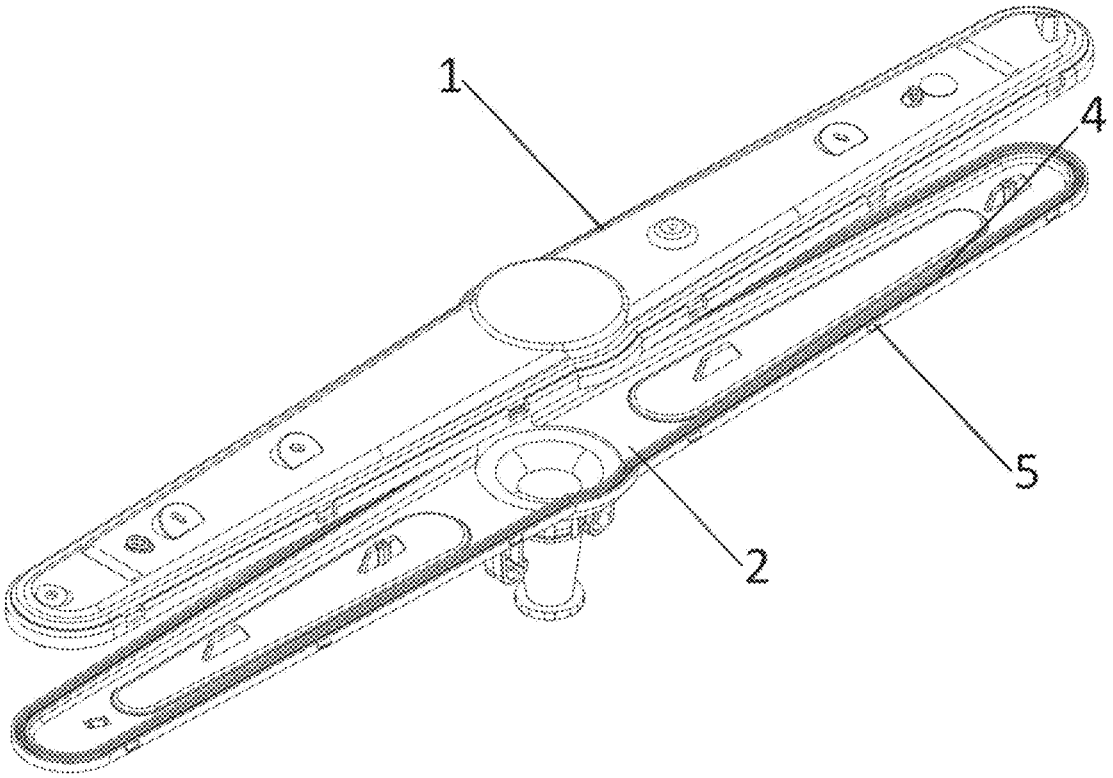
Figure 9:
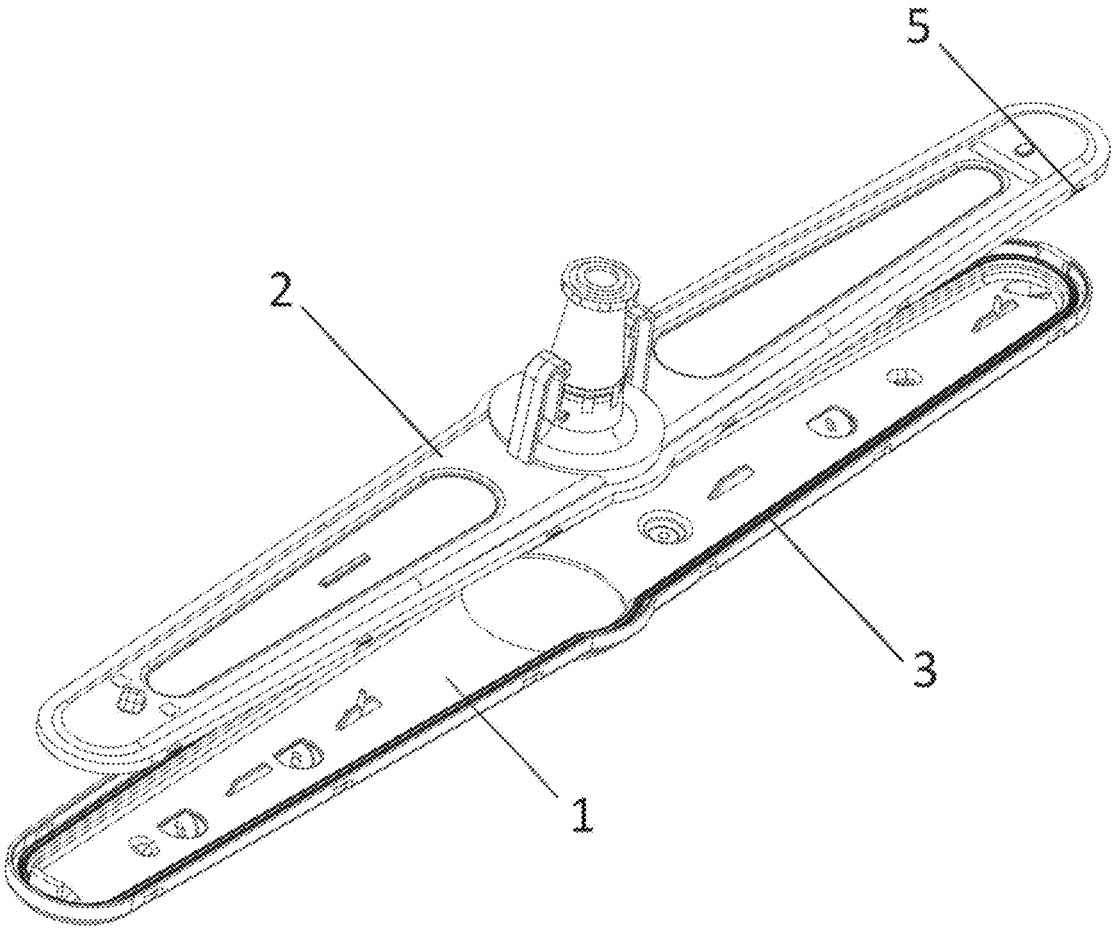
Figure 10:
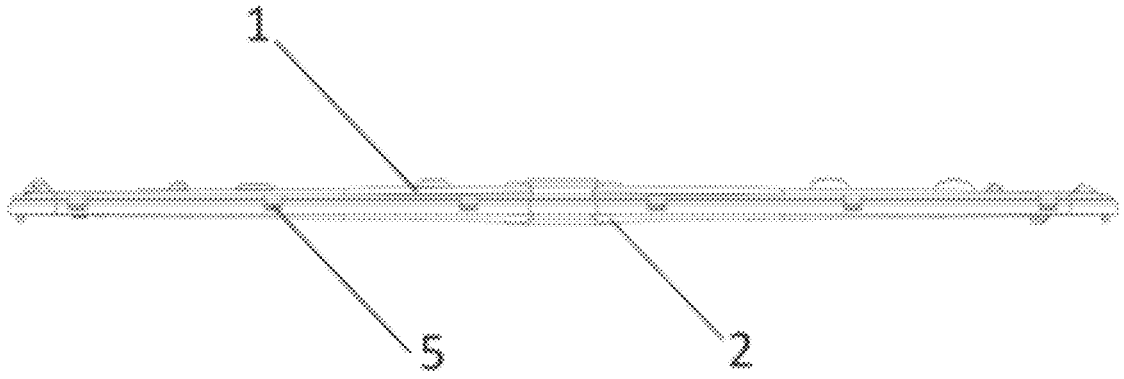
Figure 11:
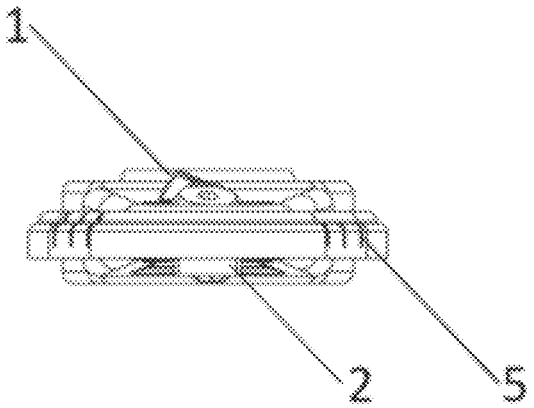
Figure 12:
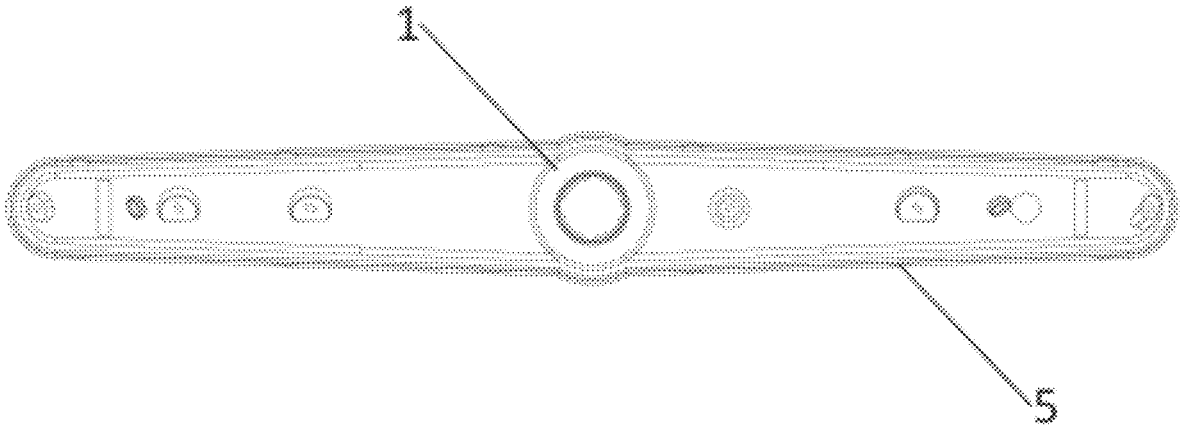
Figure 13:
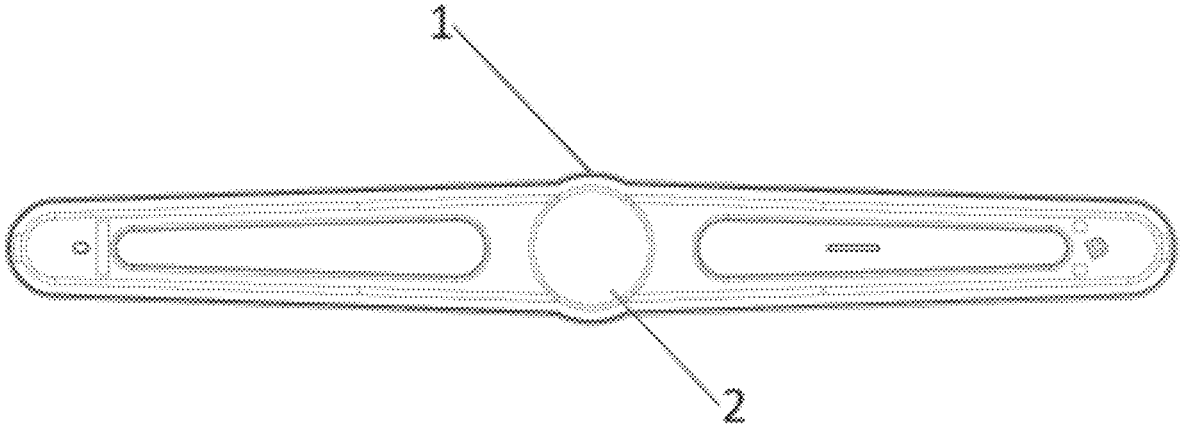
Figure 14:
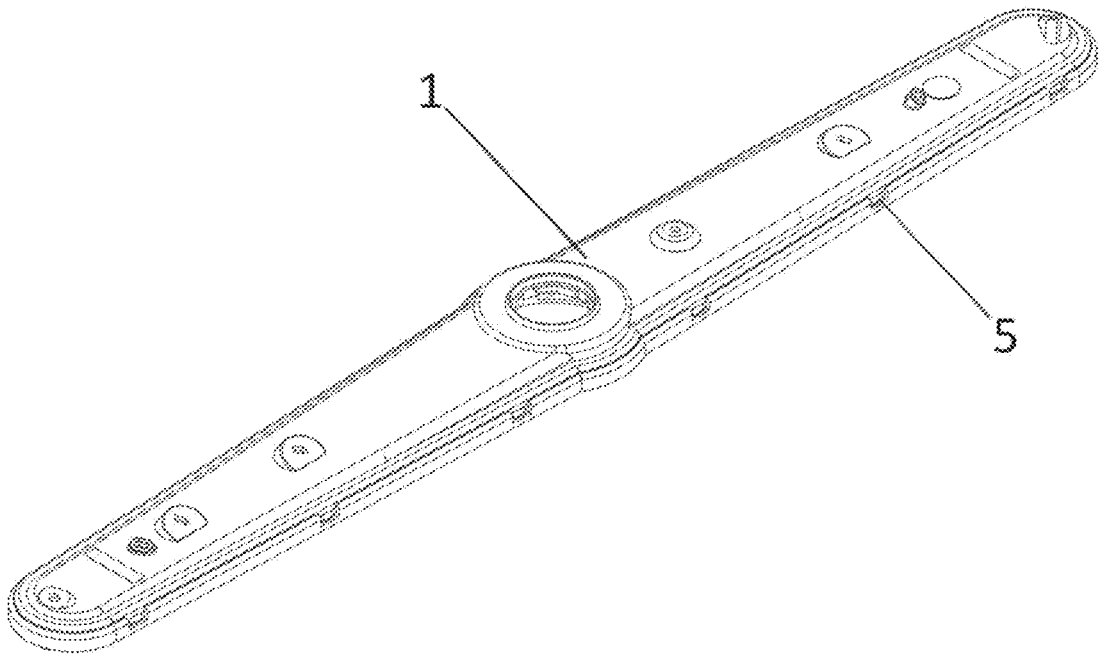
Figure 15:
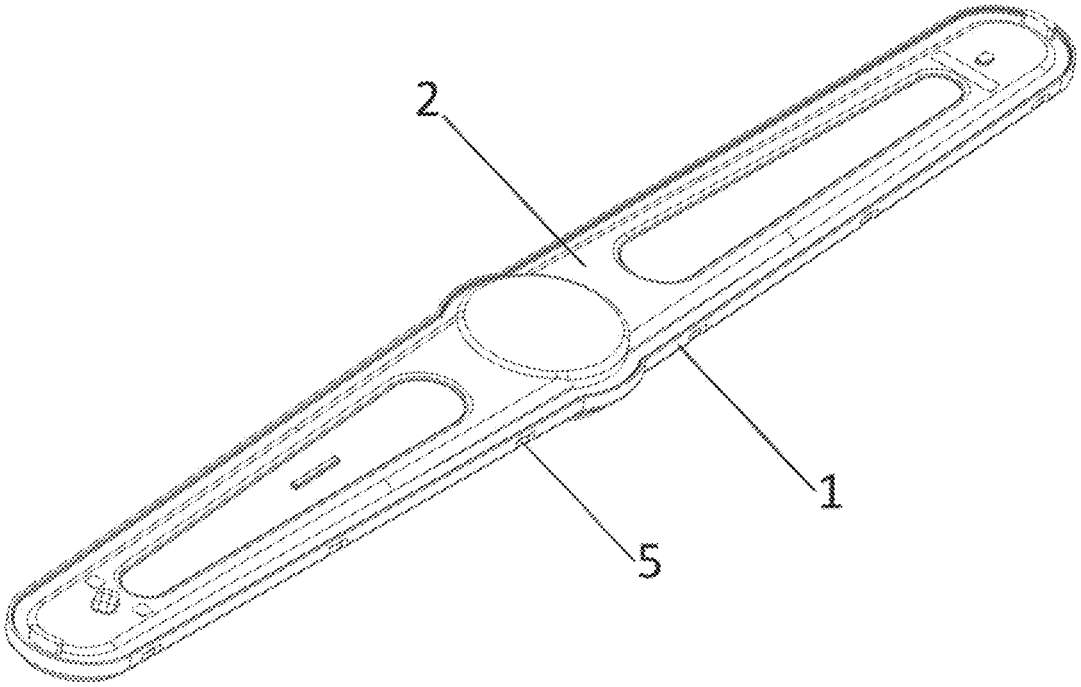
Figure 16:
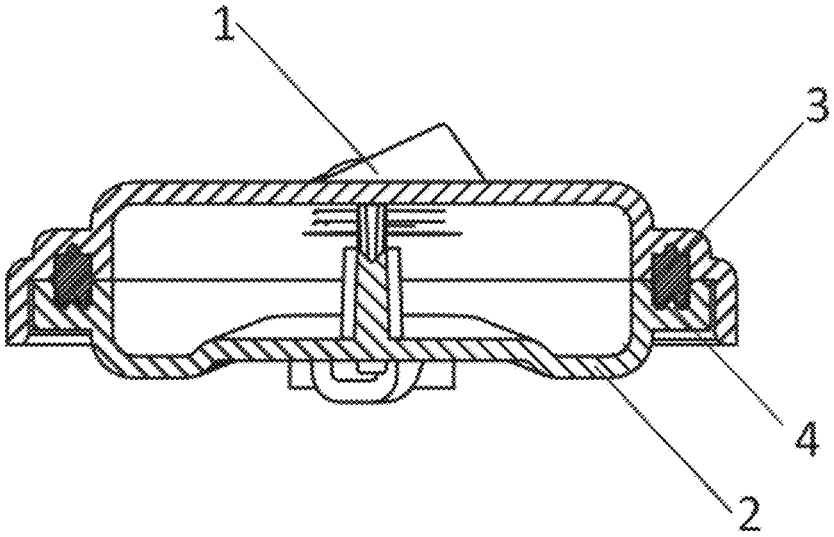
Figure 17:
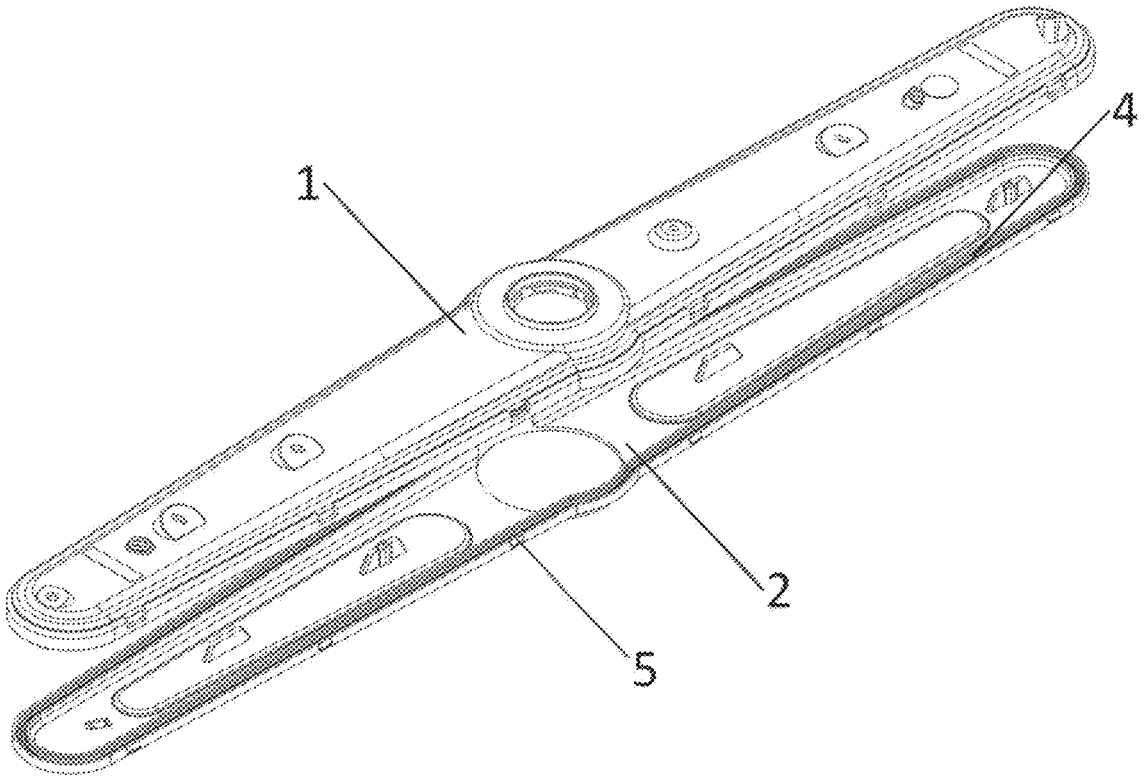
Figure 18:
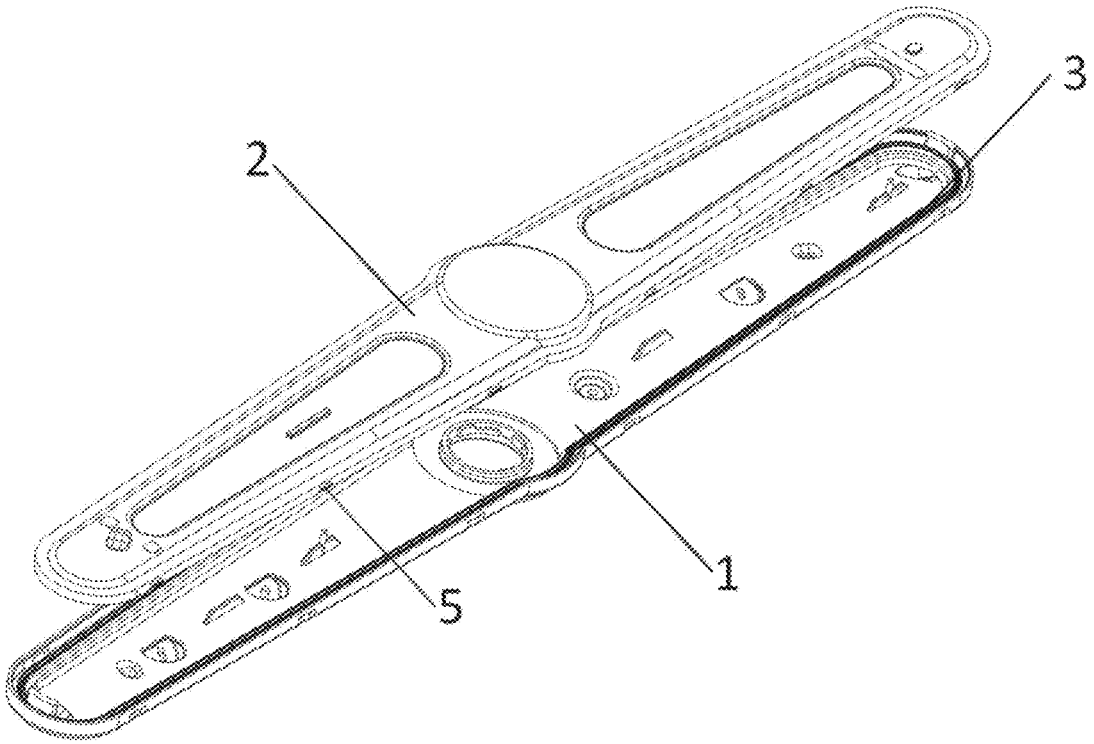
Figure 19:
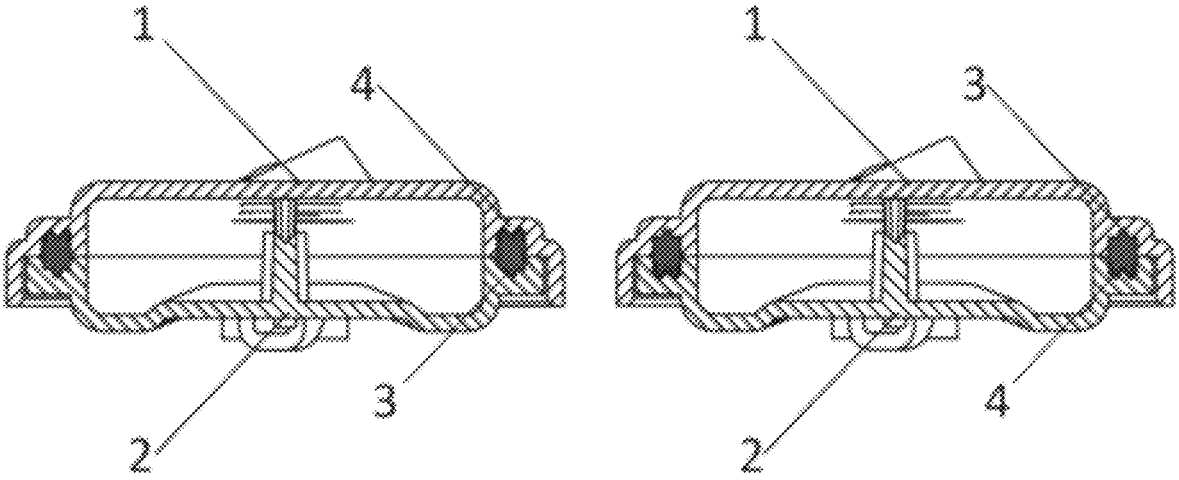

1—Propeller Upper Part
2—Propeller Lower Part
3—Upper Part Sealing Element
4—Lower Part Sealing Groove
5—Propeller Mounting Clamps

What is claimed is:

1. Rotating injection propeller assembly with a sealing effect, comprising a first propeller comprising:

an upper part (1);

a lower part (2) positioned opposite the upper part (1) and engaged to the upper part (1); and a first sealing element (3) provided between the upper part and the lower part (2);

wherein, the first sealing element (3) defines a triangle section on a first side of the first sealing element (3), the triangle section providing sealing effect by stretching against the upper part; and the first sealing element (3) defines a round section on a second side of the first sealing element (3), the second side being opposite the first side, the round section providing the sealing effect by compressing against the lower part.

* * * * *